United States Patent [19]

Bayne

[11] 4,092,990

[45] June 6, 1978

[54] VIBRATORY COIN FEEDER

[75] Inventor: Robert T. Bayne, Carmel, Ind.

[73] Assignee: Standard Changemakers, Inc., Indianapolis, Ind.

[21] Appl. No.: 613,074

[22] Filed: Sep. 15, 1975

[51] Int. Cl.[2] ..... G07D 1/00

[52] U.S. Cl. ..... 133/1 R; 221/10; 221/174; 221/175; 221/200

[58] Field of Search ..... 221/10, 174, 178, 200, 221/202, 175, 179–184, 167; 133/3 A, 4 R, 3 H, 1 R, 8 R, 8 A, 8 C; 198/287, 220 BC, 220 DC, 391, 771; 222/56, 64, 199–200

[56] References Cited

U.S. PATENT DOCUMENTS

| | | | |
|---|---|---|---|
| 2,354,717 | 8/1944 | Treciokas | 221/10 |
| 2,684,782 | 7/1954 | Lime et al. | 221/174 |
| 2,770,352 | 11/1956 | Moller | 221/174 X |
| 3,127,001 | 3/1964 | Ferris | 198/391 X |
| 3,187,884 | 6/1965 | Carrier, Jr. | 222/199 X |
| 3,319,636 | 5/1967 | Verbeke | 221/182 X |
| 3,326,223 | 6/1967 | Shikanosuke | 133/8 R |
| 3,658,172 | 4/1972 | Hacker | 198/220 A |
| 3,795,252 | 3/1974 | Black | 133/3 A |
| 3,863,546 | 12/1958 | Josefowicz | 221/10 X |

FOREIGN PATENT DOCUMENTS

| | | | |
|---|---|---|---|
| 272,892 | 5/1970 | U.S.S.R. | 222/199 |
| 123,020 | 3/1958 | U.S.S.R. | 190/220 BC |

*Primary Examiner*—Stanley H. Tollberg
*Assistant Examiner*—Charles A. Marmor
*Attorney, Agent, or Firm*—Woodard, Weikart, Emhardt & Naughton

[57] ABSTRACT

An apparatus for feeding coins by vibration. An electromagnet is mounted upon a frame being operable to cyclically attract and repel an armature fixedly mounted to and beneath a horizontally extending platform supported above the frame by a plurality of springs. A coin cup is mounted atop the platform and receives coins from a hopper suspendedly mounted above the cup by a plurality of members mounted to the frame. In the alternate embodiment, the hopper includes a top portion supported by the members and a bottom portion connected to the top portion by a vibration isolator. The bottom portion extends freely into the cup which includes a coin outlet opening onto the platform. The coins exit the platform through a second outlet falling into a coin tube leading to a coin dispenser.

3 Claims, 12 Drawing Figures

VIBRATORY COIN FEEDER

BACKGROUND OF THE INVENTION

1. Field of the Invention

This invention is in the field of devices for dispensing coins.

2. Description of the Prior Art

A variety of devices have been provided for feeding and sorting coins. Early attempts to sort and feed coins involved manually shaking the coins through different sized helical flights such as disclosed in the U.S. Pat. Nos. 1,212,215 issued to W. E. Harkness and 1,275,155 issued to G. N. Hinds. A more recent device separates the coins by causing relative motion between stacked tables having different sized coin slots thereon such as disclosed in U.S. Pat. No. 3,277,903 issued to T. J. Ganatsiou. Other devices have provided vibrating platforms using an electromagnet to vibrate the coins with such a sorter being disclosed in U.S. Pat. No. 3,434,482 issued to G. Zimmermann. A variety of rotating coin platforms have also been provided such as disclosed in U.S. Pat. No. 2,881,975 issued to C. S. Bower.

A disadvantage of many of the prior art coin feeders is the relative small coin storage capability. For example, in many coin dispensers, it is desirable to provide a large coin storage capability thereby precluding frequent filling of the coin hopper. The size of the electromagnet limits the number of coins which are to be vibrated and stored. Disclosed herein is a coin hopper which includes a bottom portion vibrated by the electromagnet whereas the top portion of the hopper which also stores coins is vibration isolated from the electromagnet. A multiple coin hopper arrangement is disclosed in U.S. Pat. No. 2,338,575 issued to F. F. Daugherty.

A major disadvantage of the prior art feeders is the frequent jamming of the coins within the feeder. Disclosed herein is a feeder which moves the coins outwardly in a helical path onto a horizontal platform. The coin motion is achieved by supporting the platform by a plurality of leaf springs and driving the platform with an electromagnet. Leaf springs are well known to support vibrating platforms with one such device being disclosed in U.S. Pat. No. 3,658,172 issued to Harold R. Hacker. A beveled ring is provided on applicant's platform for camming the coins in a manner preventing jamming of the coins on the platform. In the preferred embodiment, a pivoting gate limits the number of coins on the platform to prevent jamming.

Yet another major disadvantage of the prior art coin feeders is the constant turning on and off of the electromagnet whenever it is desired to dispense a coin. The feeder disclosed herein is provided with means for storing a stack of coins to be dispensed and further includes a sensor which activates the electromagnet only when the stack of coins is below a predetermined level.

SUMMARY OF THE INVENTION

One embodiment of the present invention is a coin feeder comprising a receptacle for holding coins and having a coin outlet, a tube connected to the receptacle at the coin outlet for receiving coins therefrom in a stack, vibrating means operable to vibrate the receptacle and the tube to impart motion to coins in the receptacle moving the coins out through the coin outlet and to impart motion to coins in the tube preventing the coins from jamming and, sensing means at the tube and connected to the vibrating means being operable to sense the level of the stack of coins in the tube and to activate the vibrating means when the level is below a predetermined level.

A further object of the present invention is a coin feeder comprising a receptacle for holding coins and having a first coin outlet, a platform having a coin supporting surface and an outer wall with a second coin outlet located adjacent thereto, the platform having a raised portion with a sloping surface extending downwardly to the supporting surface, the raised portion being located beneath the first coin outlet to receive coins therefrom, the sloping surface being sized to cam coins moving from the raised portion to the second coin outlet preventing coins from jamming therebetween, drive means connected to the platform operable to vibrate the platform to impart motion to the coins moving the coins from the raised position toward the second coin outlet.

It is an object of the present invention to provide a new and improved coin feeder.

A further object of the present invention is to provide a coin feeder having a large coin storage capacity.

Yet another object of the present invention is to provide a more efficient vibratory coin feeder.

Likewise, an object of the present invention is to provide a coin feeder having means preventing coins from jamming within the feeder.

An additional object of the present invention is to provide a vibratory coin dispenser which does not require activation of its vibrating feeding means upon every instance of coin dispensing.

Related objects and advantages of the present invention will be apparent from the following description.

DESCRIPTION OF THE PREFERRED EMBODIMENTS

Figure 1:
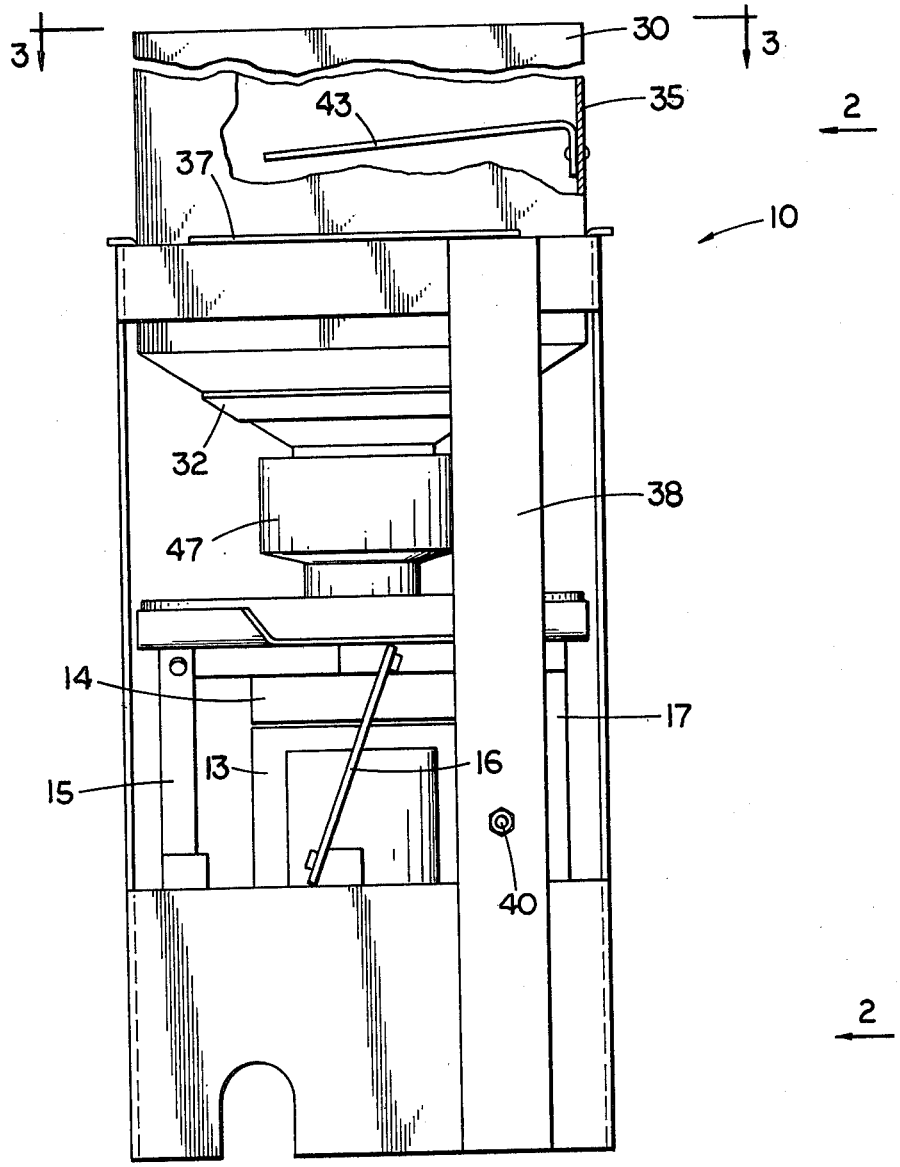
FIG. 1 is a fragmentary side view of an alternate embodiment of a coin feeder incorporating the present invention.
Figure 3:
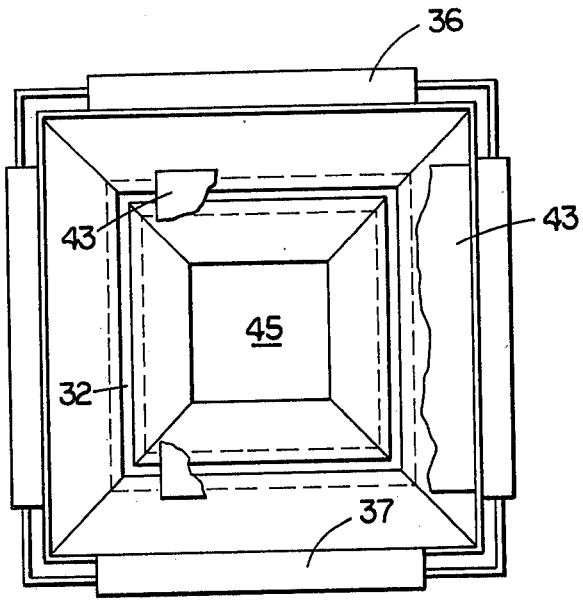
FIG. 3 is a fragmentary top view of the coin feeder of FIG. 1 looking in the direction of arrows 3—3.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
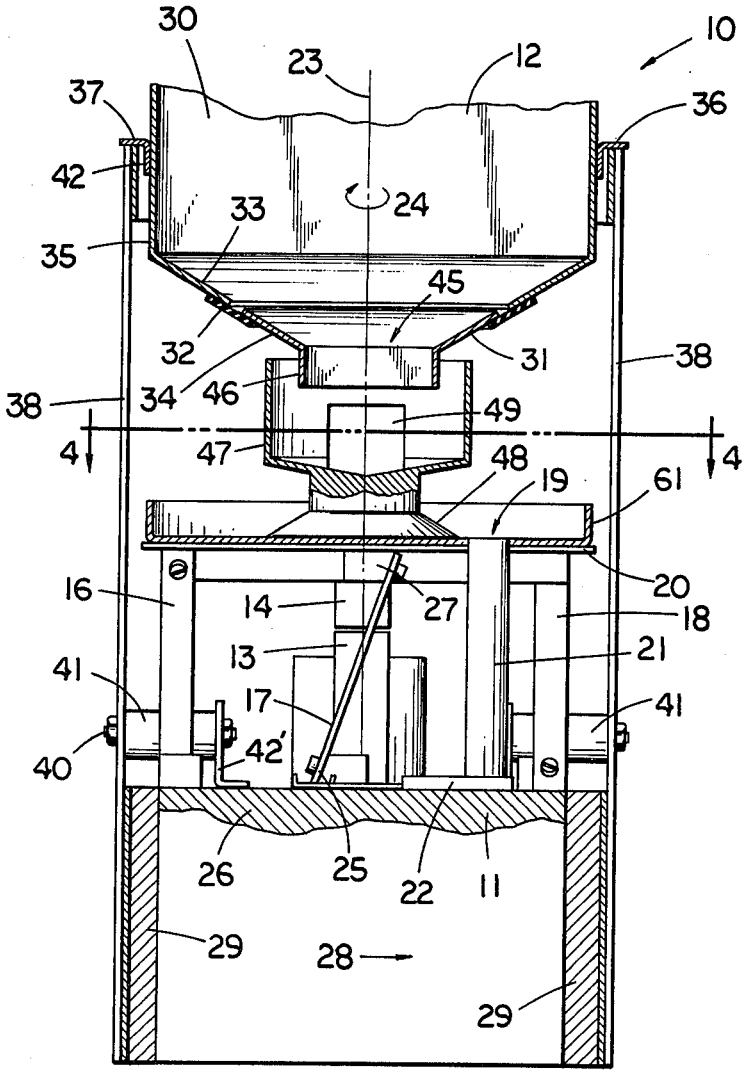
FIG. 2 is a fragmentary view of the coin feeder of FIG. 1 looking in the direction of arrows 2—2.

Now referring more particularly to FIGS. 1 and 2, there is shown an alternate embodiment of the present invention. Vibratory coin feeder 10 includes a main frame 11 with a hopper 12 mounted thereto. Hopper 12 is adapted to receive a plurality of jumbled coins and to dispense the coins to a platform 20 positioned beneath the hopper. An electromagnet 13 is mounted to frame 11 and is connected to a source of power with the magnet being operable to attract and repel armature 14 mounted to and beneath platform 20. The armature is normally spaced apart from the magnet and is resiliently held with platform 20 by four leaf springs 15 through 18. The electromagnet is operable to vibrate the hopper and platform moving the coins from the hopper onto the platform and then outwardly through an aperture 19 in platform 20 and into coin tube 21. Dispensing means 22 is positioned at the bottom of coin tube 21, and is operable to dispense coins from the coin tube in a controlled, predetermined amount.

The coin feeder is designed so as to cause the coins on the platform 20 to move around vertical axis 23 in the direction of arrow 24. In the embodiment shown in FIGS. 1 and 2, the leaf springs are spaced 90° apart around the vertical axis of rotation 23; however, three leaf springs may be utilized in lieu of four leaf springs. The leaf springs are spaced apart 120° in the event that only three springs are used to support the platform above the frame. Each leaf spring extends from the bottom of the frame upwardly toward the platform being inclined in a direction opposite of the desired direction of coin movement. For example, leaf spring 17 has a bottom end 25 mounted to base 26 with the top end 27 of the leaf spring being attached to platform 20. Leaf spring 17 extends in the direction of arrow 28 from its bottom end toward its top end which is opposite to the direction of coin movement 24. Likewise, the three remaining leaf springs extend in a direction opposite of arrow 24. The cooperative effect of the magnet force pulling the platform 20 downwardly with the spring forcing the platform upwardly along with the coefficient of friction of the platform top surface results in the coins moving in a clockwise direction as shown by arrow 24 as viewed from the top of the feeder whereas the leaf springs extend from their bottom ends to their top ends in a counterclockwise direction.

Another important consideration in the proper design of rotary vibratory feed tables is magnification of motion due to reasonance. In general, with a vibratory table used to circulate or move objects on the table surface, it is desirable to insure that the natural frequency of the spring and table system is high with respect to the alternating current excitation frequency. If the frequency of the exciting current is 120 cycles per second, then by insuring the natural frequency of the table is at least three times the excitation current frequency will result in little variation of the amplitude of the table motion with variations in mass loading of the table. The natural reasonant frequency of a rotary table and spring combination is $$1/f = 2\pi\sqrt{I\,\theta/T}$$

where I is the rotary moment of inertia, $\theta$ is the radians of angular displacement, and T is the torque of the applied couple. Typical motion of a properly designed rotary feed table will enable coins to travel with a velocity of approximately two inches per second. Typical electromagnets have pulling forces of approximately 20–25 pounds whereas the amplitude of rotary vibration is typically 0.030 to 0.060 inches in a horizontal plane.

A further factor influencing the design of the rotary table is the ratio of the rotary inertia of the base to the rotary inertia of the table. The rotary inertia of the base is maximized by concentrating the weight at the outer edges of the base frame and using massive structural members such as heavy steel bar along the outer edges of the base. Typically, the rotary inertia of the base should be at least five times the rotary inertia of the table to obtain best results. The heavy steel bars 29 are provided in base 26 and may be covered with sheet metal or other suitable material to provide a high rotary moment of inertia about axis 23 for base 26.

Hopper 12 has a top section 30 and bottom section 31 connected together by a vibration isolator 32. Both the bottom and top sections of the hopper have angular sides 33 and 34 which slope approximately 15° from the horizontal. In addition, the top section has a vertical continuous wall 35 integrally joined to sloping wall 33. Fixedly attached to wall 35 is bracket 36 which extends around the top section of the hopper. Bracket 36 has a horizontal wall 37 and a vertical wall 42 connected together with wall 42 being connected to the hopper and wall 37 being seatingly supported by a plurality of members 38 extending downwardly and being attached to frame 11. In the embodiment shown in the drawing, four members 38 are used to support the top section of the hopper. Each member 38 has a bottom end connected to base 26 by standard fastening devices 40. Each fastening device 40 extends through a vibration isolator 41 which is positioned between members 38 and bracket 42' secured to base 26. Thus, members 38 are vibration isolated from the frame of the feeder.

Vibration isolator 32 may be secured to walls 33 and 34 of the hopper by conventional fastening devices (not shown). For example, threaded bolts may extend through member 32 and wall 33 and likewise through member 32 and wall 34. As a result of the use of isolators 32 and 41, members 38 and the top section of hopper 12 will not vibrate in accordance with the vibration generated by the electromagnet insuring that noise is kept to a minimum. Likewise, since brackets 36 rest upon members 38, the weight of the coins supported by wall 33 will be transferred to members 38 thereby reducing the amount of force required for the electromagnet to vibrate platform 20.

A baffle 43 (FIG. 1) is mounted to wall 35 of the hopper and extends partially across the hopper thereby supporting at least a portion of the coins located above the baffle and thereby reducing the amount of force required for the electromagnet to move the coins on platform 20. Baffle 43 extends over the hopper coin outlet 45 of the hopper.

The lower section 31 of hopper 12 includes a continuous vertical wall 46 integrally joined to sloping wall 34. Wall 46 extends between a continuous vertical wall 47 forming a coin cup which is fixedly mounted to and above a beveled ring 48 provided on platform 20. Wall 46 provides a coin outlet 45 allowing the coins within the hopper to pass into the coin cup. A coin slot 49 is provided on wall 47 allowing the coins to pass therethrough onto the beveled ring 48 and eventually onto the platform. Coins are fed by the top hopper assembly into the coin cup where the coins completely fill the coin cup. Coins in the cup are rotated interiorly around wall 47. Slot 49 is typically of the height of a coin diameter and the length of two coin diameters. In certain cases, the coins are fed from the slot in multiple groups or in single fashion depending upon chance. The dimensions discussed above for the coin slot provide an optimum rate of coin feed to the table so that the table will accumulate two to three layers of coins on its top surface. The coins are spun out by the vabrating platform in spiral fashion until the outermost coins pass over hole 19 in the platform and drop into the coin tube. Hole 19 is slightly larger than the diameter of the coins contained in the hopper. Thus, any coins of larger diameter will continue to rotate around the platform without giving rise to a coin jam in tube 21. The larger coins simply are left on the table and are never dispensed.

Figure 4:
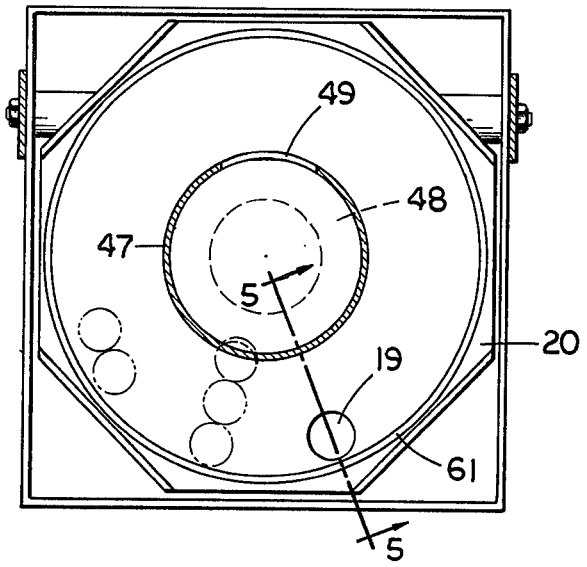
FIG. 4 is a cross-sectional view taken along the line 4—4 of FIG. 2 and viewed in the direction of the arrows.

The purpose of beveled ring 48 is to prevent coins from jamming on the platform. As shown in FIG. 4, the coins will be prevented from jamming against the outer wall 61 of platform 20 since the innermost coin 51 will be cammed upward so that the pressing force of the coins will never become sufficient to cause a coin jam. It can be appreciated that without beveled ring 48, coin 51 would be laying flat upon the top surface of platform 20 thereby providing for the possible jamming of the coins against outer wall 61 in locations other than immediately adjacent coin tube 21.

Coin tube 21 is fixedly connected to platform 20 and therefore vibrates with the platform causing any vertical coins 52 to eventually assume a horizontal position. The bottom end 53 of the coin tube is loose-fitted with respect to slide housing 54 which in turn slidably receives a coin slide 55 attached by various means to an electrically operated solenoid 56. Slide housing 54 is of sufficient thickness and is provided with a sufficiently large slot to receive the bottom end of tube 53 in order to prevent disengagement of tube 53 from housing 54 during vibration. Likewise, the amount of vibration of tube 53 is insufficient to cause disengagement of tube 53 from housing 54. By activating solenoid 56, slide 55 is caused to move with respect to the bottom outlet of tube 21 thereby aligning an aperture within slide 55 relative to the open bottom of tube 21. Such a slide mechanism is described in the commonly assigned U.S. Pat. No. 3,359,993 which is hereby expressly incorporated by reference. The coins are dispensed one at a time by applying separate pulses of current to the dispensing solenoid. Once the aperture within slide 55 is aligned relative to the bottom of tube 21, the solenoid is actuated so as to cause the slide aperture to move away from the tube thereby allowing the coin within the slide to drop into a suitable outlet.

Figure 5:
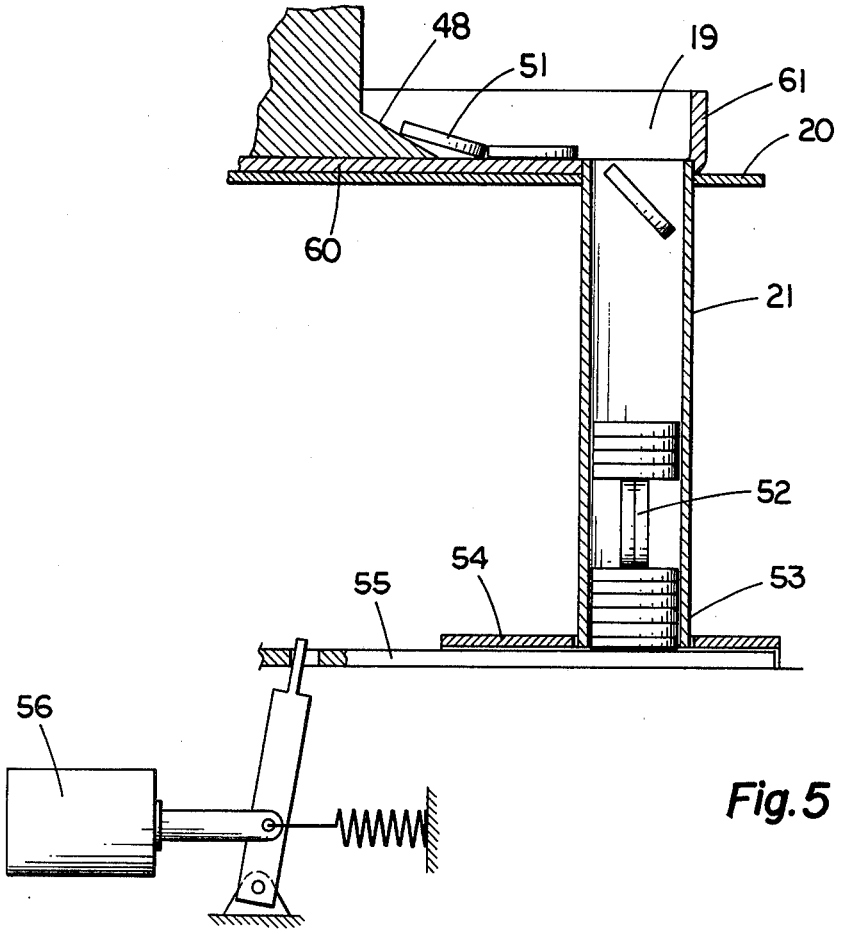
FIG. 5 is an enlarged cross-sectional view of platform 20 and coin tube 21 taken along the line 5—5 of FIG. 4 and viewed in the direction of the arrows.
Figure 6:
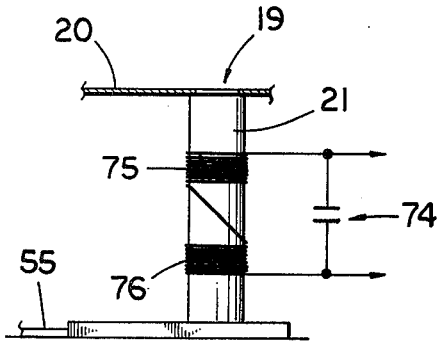
FIG. 6 is a reduced side view of the coin tube of FIG. 5 shown with a sensing device mounted thereto.

Platform 20 includes a horizontally extending supporting member 60 (FIG. 5) with a retaining wall 61 extending upwardly therefrom. The beveled ring 48 is mounted atop supporting member 60 with cup 47 mounted to the supporting member 60. Outlet 19 is located inwardly next to retaining wall 61 which extends circumferentially around the platform. Armature 14 is mounted to and immediately beneath supporting member 60 with the electromagnet being operable to cyclically attract and repulse the armature. The leaf springs 15 through 18 urge the armature apart from the electromagnet with each leaf spring having opposite ends which are out of vertical alignment at points of attachment to the frame and platform. The electromagnet in conjunction with the leaf springs is operable to impart horizontal movement of the coins in a predetermined arcuate direction 24. Likewise, the leaf springs allow platform 20 to vertically move in response to the electromagnet. Coins extending through outlet 45 vibrate with cup 47 causing the lower portion 31 of hopper 30 to vertically move in response to the electromagnet. The upper portion 33 of hopper 30 supports a portion of the coins within the hopper and transfers the weight to members 38 reducing the load of coins moved by the leaf springs and electromagnet. Sloping walls 33 and 34 in conjunction with the independent relative motion between the lower section 31 of the hopper and the top section 33 of the hopper as well as the supporting of the top section of the hopper by members 38 results in a reduction of forces which platform 20 must generate to produce a given amount of coin vibration.

A sensing means is provided to sense the level of the stack of coins within tube 21 so as to activate the electromagnet when the level of coins is below a predetermined level. The sensing means is connected to the electromagnet by suitable circuitry.

Figure 8:
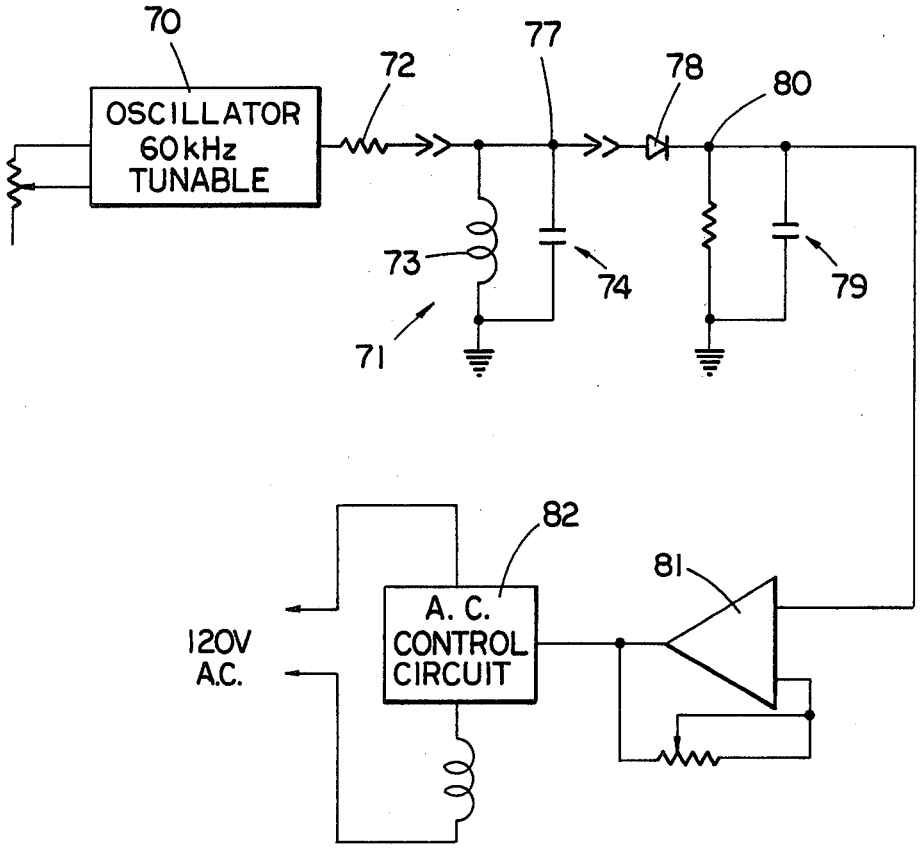
FIG. 8 is a schematic representation of the electrical circuitry for the coin sensing device.
Figure 9:
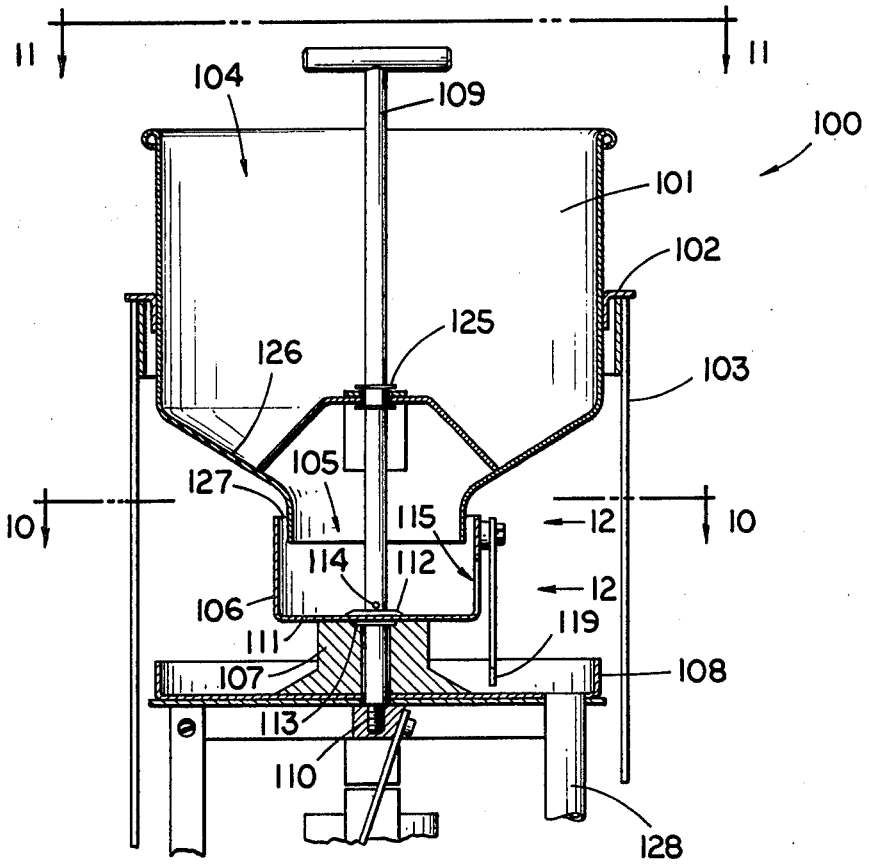
FIG. 9 is a fragmentary side view of the preferred embodiment of a coin feeder incorporating the present invention.
Figure 10:
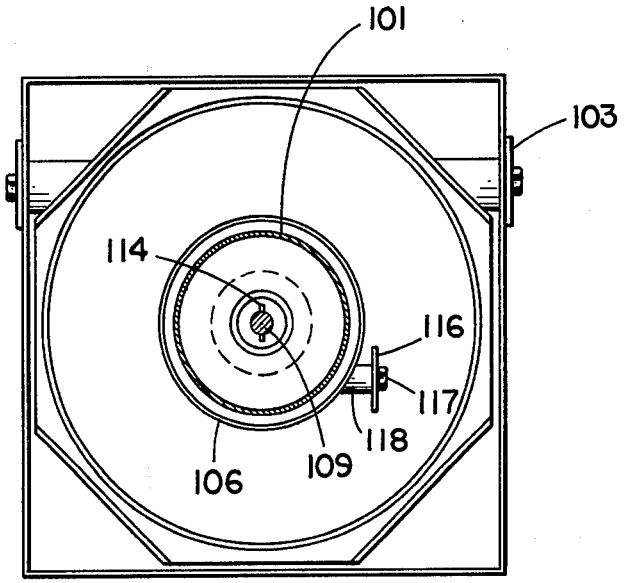
FIG. 10 is a cross-sectional view taken along the line 10—10 of FIG. 9 and viewed in the direction of the arrows.
Figure 11:
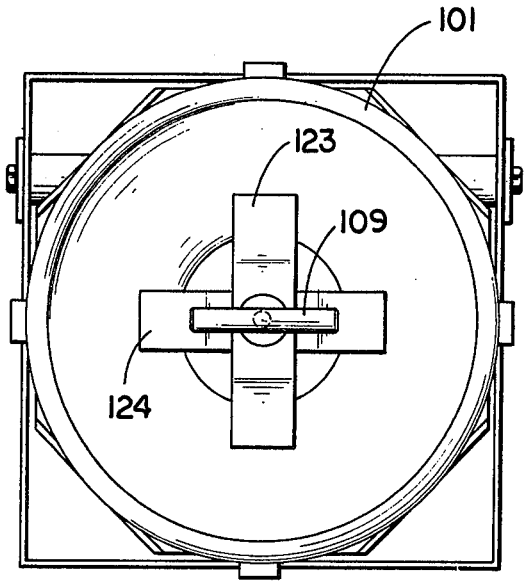
FIG. 11 is a cross-sectional view taken along the line 11—11 of FIG. 9 and viewed in the direction of the arrows.

A schematic representation of the coin sensing coil circuit is shown in FIG. 8. A signal source 70 is connected to tuned circuit means 71 which is mounted to coin tube 21. Signal source 70 may be a tunable 60 khz oscillator connected through resistance 72 to the tuned circuit means which includes an inductor 73 and capacitor 74. Inductor 73 (FIG. 8) includes a plurality of top coils 75 connected to a plurality of bottom coils 76 extending around tube 21 which is produced from a non-conductive material. Capacitor 74 is connected across coils 75 and 76 to form the parallel tuned circuit. The number of turns on the coils and the value of the capacitor is chosen so that the tuned circuit reasonates at approximately 60 khz. The sensing coil is excited by the 60 khz oscillator and with the coin tube empty, the oscillator frequency is adjusted to reasonate the sensing coil and capacitor. At reasonance, a maximum AC voltage is developed at point 77 (FIG. 8). Diode 78 and capacitor 79 convert the AC signal at point 77 to a DC voltage at point 80. The DC voltage is applied to the input of a comparator 81 containing hystersis between the "off" and the "on" states. The output of the comparator controls an AC control circuit 82 which starts or stops current to the exciting electromagnet of the coin hopper.

When the coin tube is empty, the sensing coil and capacitor 74 are at reasonance. The AC voltage at point 77 is high, the DC voltage at point 80 is high, and therefore the input to the comparator is high. Since the voltage is above the switch-in voltage of the comparator, the comparator is switched on. As a result, the AC control circuit is turned on thereby turning on the hopper electromagnet. Coins are therefore fed from the vibrating table to the coin tube and the coin tube begins to fill.

Figure 7:
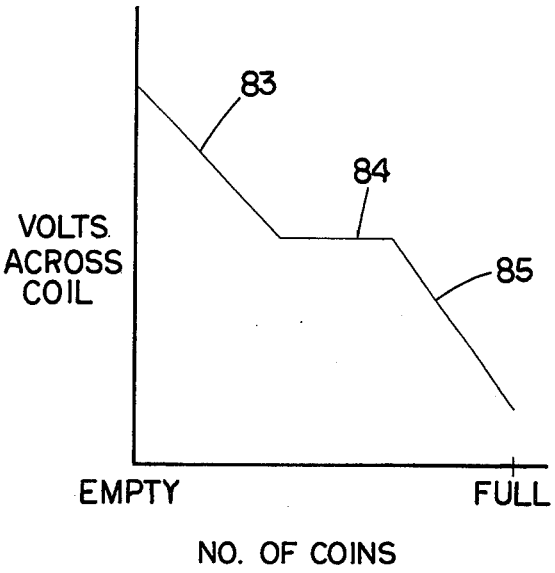
FIG. 7 is a graph representing the amount of voltage across the sensing device of FIG. 6 as a function of the number of coins within the coin tube.

As the coin tube fills with coins, the reasonant circuit is tuned progressively out of reasonance and the voltage at point 80 begins to decrease. FIG. 7 shows a graph depicting the voltage across coil 73 as a function of the number of the coins within the coin tube. As the tube fills with coins, the voltage across the coil decreases as shown by a portion of the curve identified by number 83. As soon as the level of the coins is higher than the lower coil 76, the voltage is constant as shown by that portion of the graph identified by number 84. As soon as the coin level in the tube reaches the upper coil 75, the voltage again begins to decrease as shown by portion 85 of the curve. When the voltage reaches the low switching point of the comparator, the comparator switches off. The AC control circuit now turns off and current ceases to flow to the hopper electromagnet. The hopper table stops vibrating and no further coins are fed to the coin tube. The coins now fill the tube.

Slide plate 55 is then moved by the solenoid to dispense coins from the bottom of tube 21 until the coin level is dropped just below lower coils 76 before the hopper electromagnet is energized to again fill the coin tube. The combination of a coin tube having a split coil reasonant circuit, oscillator, and a comparator containing hystersis, accomplishes an important function. The hopper need be in the "on" or "vibrating" condition infrequently. As a result, the electromagnet is not required to turn on everytime a single coin or group of coins is dispensed.

The hopper disclosed herein allows loading of the coins into the top section of the hopper in random orientation and in bulk. The electromagnet is energized to provide a circular coin vibration in the platform as previously discussed. The beveled ring and coin cup are secured to the platform and thus are set into vibration. Coins are shaken from the top hopper down into the coin cup. The bottom layer of coins in the coin cup rotates around the wall of the coin cup and individual coins are projected by the internal pressure and rotational motion through the coin port. After passing through the coin port, the coins rotate around the platform and are held within the confines of the platform by the outer retaining wall. Eventually, the coins fall into coin tube 21 forming a flat stack of coins. The coins are then dispensed by the action of the slide plate and solenoid through a hole in the base member and drop into any desired configuration of coin slide track. The coins are dispensed one at a time by applying a separate pulse of current through the dispensing solenoid.

The preferred embodiment of the vibratory coin feeder is shown in FIGS. 9 through 12. Coin feeder 100 is identical with vibratory coin feeder 10 with the exception that the top hopper is of one-piece construction with the coin cup being mounted to the pedestal on the vibrating platform by a T-shaped rod. In addition, the baffle construction within the top hopper is of a different configuration. The preferred embodiment of the hopper is also provided with a pivoting gate located adjacent the outlet of the coin cup for limiting the number of coins on the platform.

Hopper 101 includes right angle brackets 102 fixedly attached thereto identical to brackets 36 of coin feeder 10. Brackets 102 (FIG. 9) rest upon a plurality of upstanding members 103 attached to the main frame of the hopper in a manner identical with that of vertical members 38 (FIG. 2) of hopper 10. Hopper 101 has an open top 104 through which coins may be placed into the hopper. Likewise, the bottom end 105 of hopper 101 is open and extends into coin cup 106. Hopper 101 is not provided with the vibration isolator 32 shown in FIG. 2 for hopper 12.

Coin cup 106 rests upon a pedestal 107 fixedly secured to coin platform 108. A T-shaped rod 109 has a bottom end 110 which is threadedly received by coin platform 108. Rod 109 extends through the bottom wall 111 of coin cup 106. A pair of washers 112 and 113 are positioned on the opposite sides of wall 111 with washer 113 being received by a recess provided in the top surface of pedestal 107. A projection or pin 114 fixedly mounted to rod 109 forces washer 112 against wall 111. Thus, coin cup 106 is securely fastened to pedestal 107 when rod 109 is tightened thereby forcing washer 112 against wall 111.

Coin cup 106 is provided with an outlet 115 identical to outlet 49 of the cup shown in FIG. 2. A gate 116 is pivotally mounted by fastener 117 to boss 118 in turn fixedly secured to coin cup 106. The bottom end 119 of gate 116 is positioned above the top surface of coin platform 108 a distance slightly greater than the thickness of a coin.

Figure 12:
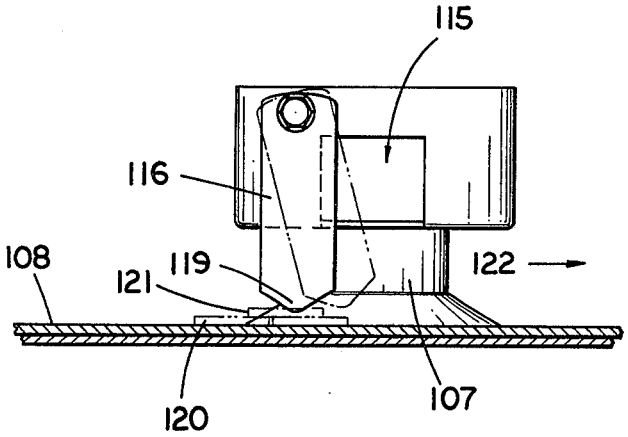
FIG. 12 is a fragmentary side view of the pivoting gate attached to the coin cup looking in the direction of arrows 12—12 of FIG. 9.

As shown in FIG. 12, a single layer 120 of coins may pass beneath gate 116 without disturbing the gate; however, when the coins are stacked in two layers 121, the bottom distal end 119 of the gate will be moved in the direction of arrow 122 as the coins vibrate around the coin platform in the direction of arrow 122. Gate 116 is mounted sufficiently close to coin outlet 115 so as to partially close the outlet as the gate swings in the direction of arrow 122. Thus, once a double layer of coins exists on the coin platform 108, the gate will then pivot thereby preventing additional coins from falling onto the platform from the coin cup. The coin cup is supported by the plurality of leaf springs identical to the leaf springs shown in FIG. 2. Likewise, an electromagnet is provided with the armature being attached to the bottom side of the coin platform 108.

A pair of perpendicularly arranged baffles 123 and 124 is mounted to retaining ring 125 attached to T-shaped rod 109. Baffles 123 and 124 extend downwardly contacting the inward sloping wall 126 of hopper 101. The bottom end of the hopper is spaced inwardly from the coin cup forming an air gap 127 (FIG. 9) providing a vibration damper between the coin cup and hopper. Once the electromagnet is activated, the coins will vibrate from the coin hopper into coin cup 106 and eventually onto the coin platform exiting the coin platform through coin tube 128 identical to the coin tube 21 shown in FIG. 2.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

The invention claimed is

1. A vibratory coin feeder comprising:

a frame;

a hopper mounted to said frame to receive jumbled coins;

a platform positioned beneath said hopper to receive coins therefrom, said platform having an outer circumferentially extending wall with a coin outlet located inwardly next to said wall;

drive means operable to vibrate said hopper and platform moving said coins from said hopper onto said platform and outwardly to said outlet;

dispensing means adapted to receive coins from said outlet and being operable to dispense coins therefrom in a controlled predetermined amount;

said hopper includes a lower portion with a hopper coin outlet and an upper portion connected together both of which support said jumbled coins; and further comprising:

isolation means connecting said lower portion to said upper portion but vibration isolating said upper portion from said lower portion;

supporting means mounted to said frame and supporting said upper portion of said hopper, said supporting means being vibration isolated from said frame;

spring means mounting said platform and said lower portion of said hopper on said frame and allowing said platform and said lower portion of said hopper to vertically move in response to said drive means;

both said upper portion and said lower portion of said hopper have downwardly slanting parallel walls to support said jumbled coins with said upper portion of said hopper supported by said supporting means reducing the load of coins supported by said spring means.

2. A vibratory coin feeder comprising:

a frame;

a coin cup to receive jumbled coins;

a platform mounted to said frame and positioned beneath said coin cup to receive coins therefrom, said coin cup being mounted on said platform, said platform having an outer circumferentially extending wall with a first coin outlet located inwardly next to said wall;

drive means operable to vibrate said coin cup and platform moving said coins from said coin cup onto said platform and outwardly to said first outlet;

dispensing means adapted to receive coins from said first outlet and being operable to dispense coins therefrom in a controlled predetermined amount;

gate means mounted above said platform being operable to limit the number of coins on said platform, said gate means including a vertically extending flat plate pivotally mounted to said coin cup about a pivot axis extending through said plate, said coin cup includes a second coin outlet adjacent said plate, said plate having an outer end spaced apart from said platform a certain distance allowing a predetermined amount of coins on said platform, said gate means operable to block said second coin outlet when said predetermined amount is exceeded and said outer end contacts said coins stacked on said platform, said plate remaining a constant distance from said coin cup as said plate swings from an open position to a closed position blocking said second coin outlet.

3. A vibratory coin feeder comprising:

a frame;

receptacle means mounted to said frame and including an inclined plane to receive coins and further an outlet sized to receive said coins of a predetermined certain diameter, said means also having a coin supporting surface extending from said outlet to said plane and further having an outer retaining wall extending upwardly from said surface being spaced apart from said plane a distance greater than twice said certain diameter but other than a multiple integer of said certain diameter preventing coin jams on said surface while assuring a constant supply of coins to said outlet;

said receptacle means having a coin inlet opening onto said plane; and further comprising:

gate means mounted above said coin supporting surface being operable to limit the number of coins on said coin supporting surface, said gate means including a vertically extending flat plate member movably mounted to said receptacle means adjacent said inlet with said gate means and member being operable to allow a predetermined amount of coin stacking on said coin supporting surface and further operable to block said inlet when said predetermined amount is exceeded.

* * * * *